US011485529B2

(12) United States Patent
Schwinn et al.

(10) Patent No.: US 11,485,529 B2
(45) Date of Patent: Nov. 1, 2022

(54) CABLE TIE MOUNTING TOOL AND CABLE TIE MOUNTING METHOD

(71) Applicant: HELLERMANNTYTON GMBH, Tornesch (DE)

(72) Inventors: Andreas Schwinn, Uetersen (DE); Taro Fukuda, Hamburg (DE)

(73) Assignee: HELLERMANNTYTON GMBH, Tornesch (DE)

( * ) Notice: Subject to any disclaimer, the term of this patent is extended or adjusted under 35 U.S.C. 154(b) by 303 days.

(21) Appl. No.: 16/555,280

(22) Filed: Aug. 29, 2019

(65) Prior Publication Data

US 2020/0094999 A1 Mar. 26, 2020

(30) Foreign Application Priority Data

Sep. 26, 2018 (EP) ..... 18196954

(51) Int. Cl.
*B65B 13/02* (2006.01)
*B65B 35/18* (2006.01)

(52) U.S. Cl.
CPC ..... *B65B 13/027* (2013.01); *B65B 35/18* (2013.01)

(58) Field of Classification Search
USPC ..... 140/57, 123.5
See application file for complete search history.

(56) References Cited

U.S. PATENT DOCUMENTS

| | | | | |
|---|---|---|---|---|
| 4,534,817 | A * | 8/1985 | O'Sullivan | B29C 65/78 156/352 |
| 5,042,635 | A | 8/1991 | Bell | |
| 5,050,649 | A | 9/1991 | Kurmis | |
| 5,205,328 | A | 4/1993 | Johnson et al. | |
| 2019/0248521 | A1 * | 8/2019 | Hillegonds | B65B 13/187 |

FOREIGN PATENT DOCUMENTS

| | | | | |
|---|---|---|---|---|
| CN | 108945564 | A * | 12/2018 | B65B 13/025 |
| EP | 0390434 | A1 | 10/1990 | |
| EP | 0561156 | A2 | 9/1993 | |
| EP | 722885 | A1 | 7/1996 | |
| JP | H0314411 | A | 1/1991 | |

(Continued)

OTHER PUBLICATIONS

Xu, Translation of CN-108945564-A (Year: 2018).*

(Continued)

*Primary Examiner* — Jessica Cahill
*Assistant Examiner* — Bobby Yeonjin Kim
(74) *Attorney, Agent, or Firm* — Billion & Armitage

(57) ABSTRACT

A cable tie mounting tool comprises an upstream jaw and a downstream jaw having concave guidance path portions for the strap of a cable tie, a placing mechanism configured to place a cable tie portion along the common concave guidance path by pushing it strap-end-first along the common concave guidance path starting at the upstream end of the upstream jaw and pushing it in downstream direction, an insertion mechanism for feeding the cable tie strap end of the placed cable tie through the head of the placed cable tie, and a tightening mechanism for tightening the cable tie and possibly cutting it. Also provided is a length adjustment mechanism for adjusting the length of the common concave guidance path.

12 Claims, 8 Drawing Sheets

(56) References Cited

FOREIGN PATENT DOCUMENTS

| | | | |
|---|---|---|---|
| JP | H04339718 | A | 5/1991 |
| JP | H04339718 | A | 11/1992 |
| JP | H068910 | A | 3/1993 |
| JP | 2002240804 | A | 8/2002 |

OTHER PUBLICATIONS

Translation of Japanese Office Action for JP Application No. 2019175412, dated Oct. 28, 2020, 7 pages.
Translation of Office Action dated May 21, 2021 for Japanese Patent Appln. No. 2019-175412; 3 pages.
Korean Notice of Preliminary Rejection; dated May 21, 2021; 7 pages.

* cited by examiner

CABLE TIE MOUNTING TOOL AND CABLE TIE MOUNTING METHOD

CROSS-REFERENCE TO RELATED APPLICATION

This application claims the benefit under 35 U.S.C. § 119(a) of European Patent Application No. 18196954.4, filed on Sep. 26, 2018, the entire contents of which are incorporated herein by reference.

TECHNICAL FIELD

The present invention relates to the field of mounting cable ties, for example when assembling cable harnesses. In cable harnesses, a plurality and possibly many cables are assembled and are affixed to each other via cable ties to be attached.

SUMMARY

A cable tie mounting tool comprises an upstream and a downstream jaw having concave guidance path portions for the strap of a cable tie, a placing mechanism configured to place a cable tie portion along the common concave guidance path by pushing it strap-end-first along the common concave guidance path starting at the upstream end of the upstream jaw and pushing it in downstream direction, an insertion mechanism for feeding the cable tie strap end of the placed cable tie through the head of the placed cable tie, and a tightening mechanism for tightening the cable tie. Also provided is a length adjustment mechanism for adjusting the length of the common concave guidance path.

The terms "upstream" and "downstream" are relative to the movement direction of a cable tie strap along the guidance path. Downstream is the direction along which the cable tie strap moves when it is inserted, and upstream is the opposite direction from which the cable tie comes when inserted.

The placing mechanism may be configured and act such that when the cable tie is placed, its free strap end rests immediately opposite of and adjacent to the strap receiving opening in the cable tie head. The distance then may be below 5 mm or below 2 mm. The insertion mechanism pushes the strap end finally through the strap head. Downstream of the head, the free end of the cable tie strap will be caught by some kind of tightening mechanism and can then also be cut-off after having been tightened.

The length adjustment mechanism is provided such that the inner circumference length of the loop formed by the closed jaws of the tool can selectively be shortened compared to a possible maximum length. This can be achieved by pushing path portions radially inward such that a long loop portion is more or less shortcut. "Radial" here refers to a direction in the loop plane towards or away from a point in the center region of the loop. A radial movement shall be a movement having a predominant radial component.

The guidance path for the cable tie needs not continuously be provided along the entire length of the cable tie strap. Cable tie straps have a certain rigidity and thus can reach across gaps in the path e.g. from one guidance path portion to another guidance path portion. This will be explained more in detail further down this specification. As far as guidance path lengths are considered, these lengths can include gaps amongst path portions, to be taken into account as they are bridged by a traveling cable tie strap.

Generally speaking, the cable ties as provided are usually straight and must be bent into loop form. Accordingly, the cable tie guidance path provided around the inner periphery of the loop formed by the closed jaws is oriented radially outward, and the guided cable tie strap is oriented radially inward and forced to bend into a loop shape by the concave shape of the various guidance path portions.

The length adjustment mechanism can automatically be operated and can, for a series of cable ties to be attached, be set once such that the inner circumferential length of the mentioned loop formed by the jaws is such that the strap end comes to rest immediately opposite of, and adjacent to, the opening in the strap head of the cable tie. Thus, the provision of the length adjustment mechanism makes the change of the jaws for the configuration to different cable tie lengths superfluous.

Both the length adjustment mechanism and the insertion mechanism may comprise at one of the jaws a pivotable path portion. Their pivot axis may be perpendicular to the plane of the opening confined by the closed jaws, so that pivoting around this pivot takes place in the plane of the opening area. Particularly, the arrangements may be such that the pivoting is radially inward into the opening or radially outward.

Generally speaking, both insertion and length adjustment shorten the length of the inner peripheral length of the loop of the cable tie strap. Shortening can be achieved by pushing guidance path portions radially inward so that a possible longer loop geometry is selectively shortcut.

A particular advantage is achieved when the pivotable path portions used for length adjustment and used for insertion are the same, configured to make the two movements for respective path shortenings as required. Then, only one movable part is required for accomplishing the two functions of path length adjustment and insertion of the cable tie end into the cable tie head. The drive of this portion is then configured to make the respective movements when and as required. Driving may be made by a controller, preferably a digital controller.

But different to what was just said, the pivotable path portions for insertion and for length adjustment may be different distinct path portions and may individually be driven as appropriate in space and time.

The jaws may be of concave shape, and likewise the pivotable path portions as well as the other path portions provided by the various components of the tool can be of concave shape. In cooperation, they form a concave guidance for the cable tie strap, forcing the strap into loop shape such that the strap end reaches back into the opening of the strap head. As already said, the guidance path may have gaps. It is not required that it supports the cable tie strap without interruptions. Likewise, it may have certain edges or portions of low radius of curvature. It needs not be circular and may have another appropriate contour.

Where the cable tie strap reaches back to the cable tie head, the guidance path portions may cross each other under a desired angle. Usually, insertion direction of the strap into the head is more or less perpendicular to the direction of the strap portion immediately formed at the head. Accordingly, likewise the guidance path portions will have, at the insertion point, a corresponding angle, i.e. substantially rectangular or corresponding to the insertion direction of the strap end into the strap head, possibly with some deviation from said direction that may be below ±20° or ±10°.

Preferably, the pivot of the pivotable path portion is provided at the upstream end of the pivotable path portion, so that the downstream end thereof is freely movable within its other constructive constraints around said pivot. By hinging the pivotable path portion at its upstream end, reactionary forces when pivoting the concerned path portion are reduced. Preferably, the pivotable path portion of the length adjustment mechanism is provided at the downstream jaw. This again reduces reactionary forces when using the pivotable path portion particularly for inserting the cable tie strap end into the cable tie head. It is preferred that the pivotable path portion of the length adjustment mechanism is pivotably attached to the upstream end of the downstream jaw. This minimizes the reactionary forces when reducing the loop circumference by pivoting the pivotable path portion.

The drive mechanism of the pivotable path portion is configured to drive individual steps of said pivotable path portions as required. Particularly, it may adjust, in a first step for reducing the peripheral length of the loop provided by the closed jaws, the length to a value corresponding to the strap length of a presently used cable tie. Then, when using the tool for actual cable tie mounting, this general setting may be maintained, and further circumference reducing steps may be driven for inserting the cable tie strap end into the cable tie head.

The first step for length adjustment may be an absolute step in the sense that it is selected in dependence of the cable tie length to be handled, whereas the second inserting step may be an incremental step for pushing the cable tie strap end through the cable tie head to an extent such that a tightening mechanism downstream of the cable tie head can catch the cable tie strap end for tightening it.

Again generally speaking, the guidance path portions of the upstream jaw and of the downstream jaw have different lengths. The length adjustment mechanism is preferably provided at the jaw having the longer of the two guidance path portions. This gives sufficient room for the pivotable path portion to provide for sufficient dimensional variation of the loop circumference for shortening/adjusting the guidance path length and for inserting the strap end into the head.

Looking at the jaw having the pivotable path portion, this jaw preferably also has a fixed path portion cooperating with the pivotable path portion. All these path portions can be held by a holder of concave contour. The holder itself must be concave because also the holder must reach around the items to be tied. Particularly, the holder may hold the pivot of the pivotable path portion and may hold the fixed path portion in fixed and well-defined manner in relation to the pivotable path portion.

Particularly, the pivot of the pivotable path portion may sit at the upstream end of the holder when it is all provided at the downstream jaw. The free-downstream-end of the pivotable path portion points to a fixed path portion and will guide the cable tie strap towards varying positions along the fixed guidance path depending on the pivoting position of the pivoting path portion. A variable gap may be provided between the downstream end of the pivotable path portion and the fixed path portion, depending on the pivot position of the pivotable path portion. Nevertheless, the fixed path portion is designed such that it securely catches the arriving free end of the cable tie strap and then guides it downstream.

One or more of the guidance path portions may have a U-shaped cross-sectional contour with a flat bottom for receiving the strap of the cable tie. The U-shaped contour may be shallow and have relatively short legs. Generally speaking, the length of the legs can be selected such that on the one hand side the cable tie strap is safely caught and guided and is prevented from escaping sideways, but is preferably kept small enough for avoiding unnecessary increase of frictional forces and other unwanted effects. The sidewalls of the guidance path portions profile may be relatively high where the guidance path has small radii of curvature because the likelihood of escaping is higher at such portions.

So far, a construction was described that is configured to independently handle guidance path length adjustment and the insertion of the cable tie strap end into the cable tie head. But for receiving similar effects also another approach can be considered, namely to have no particular length adjustment mechanism. Instead, an insertion mechanism is provided that can implement different step lengths for the insertion depending on the length of the cable tie to be mounted.

Assuming that the loop length of the guidance loop provided by the closed jaws does not change, it will remain the same both for long and for short cable ties. Then, layout must be made such that the longest cable ties to be handled must fit into the loop. Then, shorter cable ties will not fill out the loop. Further, since the cable tie head must be held at a predefined position, the cable tie strap end will come to rest at different positions along the loop, and accordingly, when the cable tie strap end is to be inserted into the cable tie head, different step lengths of the pivotable path portion for inducing the inserting effects are required. For shorter cable ties (having their ends resting remote from the head) a longer pivoting step is required, and vice versa. Thus, in these embodiments, there is no extra (initiating) path length adjustment required. But provisions must be made for obtaining the appropriate pivoting length when inserting the cable tie strap end into the cable tie head.

These provisions may again be implemented by an appropriate control. But likewise, some kind of self-adjusting mechanisms may be chosen, for example driving the pivotable path portion until a certain resisting force is encountered, or the like.

A method for automatically mounting a cable tie by a tool around items to be tied, comprises the following steps:

(1) adjusting the length of a common guidance path for the cable tie in the tool,
(2) opening two concave jaws of the tool, the jaws forming, when closed, said common guidance path for the cable tie,
(3) approaching the items to be tied and the opened jaws,
(4) closing the jaws such that the items to be tied are surrounded by the jaws,
(5) placing a cable tie along the common guidance path,
(6) feeding the cable tie end through the cable tie head
(7) tightening and possibly cutting the free end of the cable tie, and optionally
(8) repeating the steps (2) through (7) in the above sequence.

All steps may be executed automatically. Step (1) may be executed semi-automatically, for example by manually selecting a setting from a menu, the selected setting then being set automatically, or may be made manually by adjusting the common guidance path portion to the length of the cable ties to be used. Step (3) can be made automatically, e.g. by a robot holding and moving the tool, or manually by a worker working with the tool along a harness for attaching the required cable ties.

BRIEF DESCRIPTION OF DRAWINGS

The accompanying drawings, which are incorporated in and constitute a part of the specification, illustrate embodiments of the present disclosure, and together with the general description given above and the detailed description of the embodiments given below, serve to explain the principles of the present disclosure.

DETAILED DESCRIPTION

Figure 1:
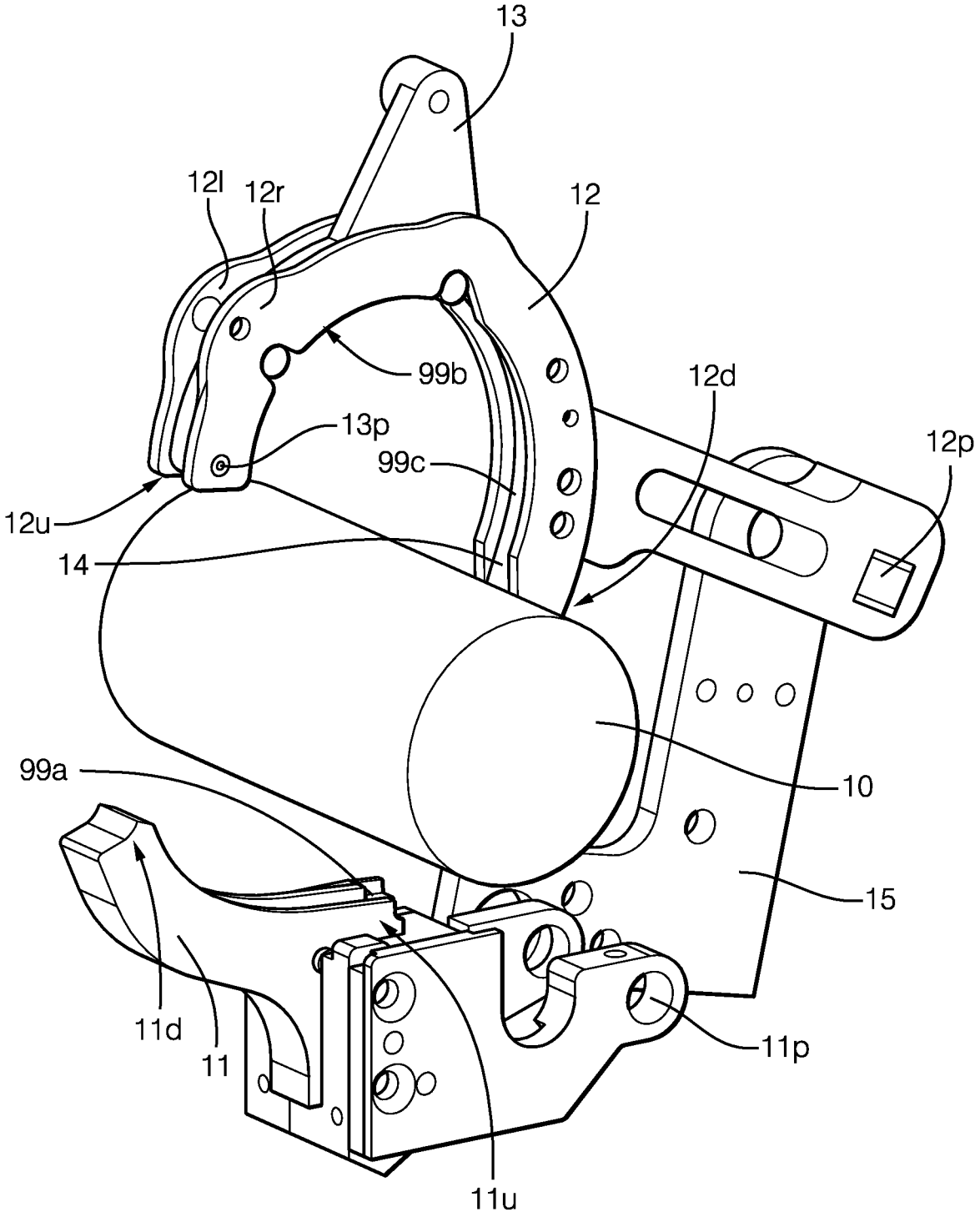
FIG. 1 shows a perspective view of the head part of a tool for mounting cable ties according to an embodiment of the invention.

FIG. 1 shows the head part of a tool for mounting cable ties. Not shown are several components of the tool that are required for its operation, such as a tool body, a supply mechanism for the cable ties, a cutting mechanism, a tightening mechanism, operating switches, drives and the like. FIG. 1 shows the jaw portion of the tool as it may sit on the left side of an appropriately configured tool.

Reference numeral 10 symbolizes the items to be tied by a cable tie. For simplification it is drawn as a cylinder, but usually it is a bunch of cables, tubes and the like to be tied together. 11 is the upstream jaw with its upstream end 11*u* and its downstream end 11*d*. Numerals 12, 13 and 14 constitute together the downstream jaw with its upstream end 12*u* and its downstream end 12*d*. Both are shown to be pivotable around their respective pivots 11*p* and 12*p*. Their pivoting movement is used for opening and closing the jaws, opening being such that the downstream end 11*d* of the upstream jaw 11 and the upstream end 12*u* of the downstream jaw 12, 13, 14 are remote from each other so that the items to be tied 10 can get into the opening defined by the two jaws.

The upstream jaw 11 defines and forms an upstream guidance path 99*a*. The downstream jaw 12, 13, 14 defines and forms a downstream guidance path 99*b*, 99*c*. The guidance path is for guiding the strap 62 of a cable tie 61-63.

FIG. 6 shows schematically the situation where a cable tie 61, 62, 63 is placed along the guidance path 99 constituted by the guidance path portions 99*a*, 99*b*, 99*c*. For the sake of clarity, FIG. 6 shows the strap portion 62 of the cable tie a little bit radially inward distant from the guidance path portions 99*a*, 99*b*, 99*c*. But in real operation, the strap portion 62 will abut at least along long portions of the guidance path 99, noting that at certain portions, particularly at edgy portions of the overall guidance path 99, it may lift off from the guidance path.

Figure 6A:
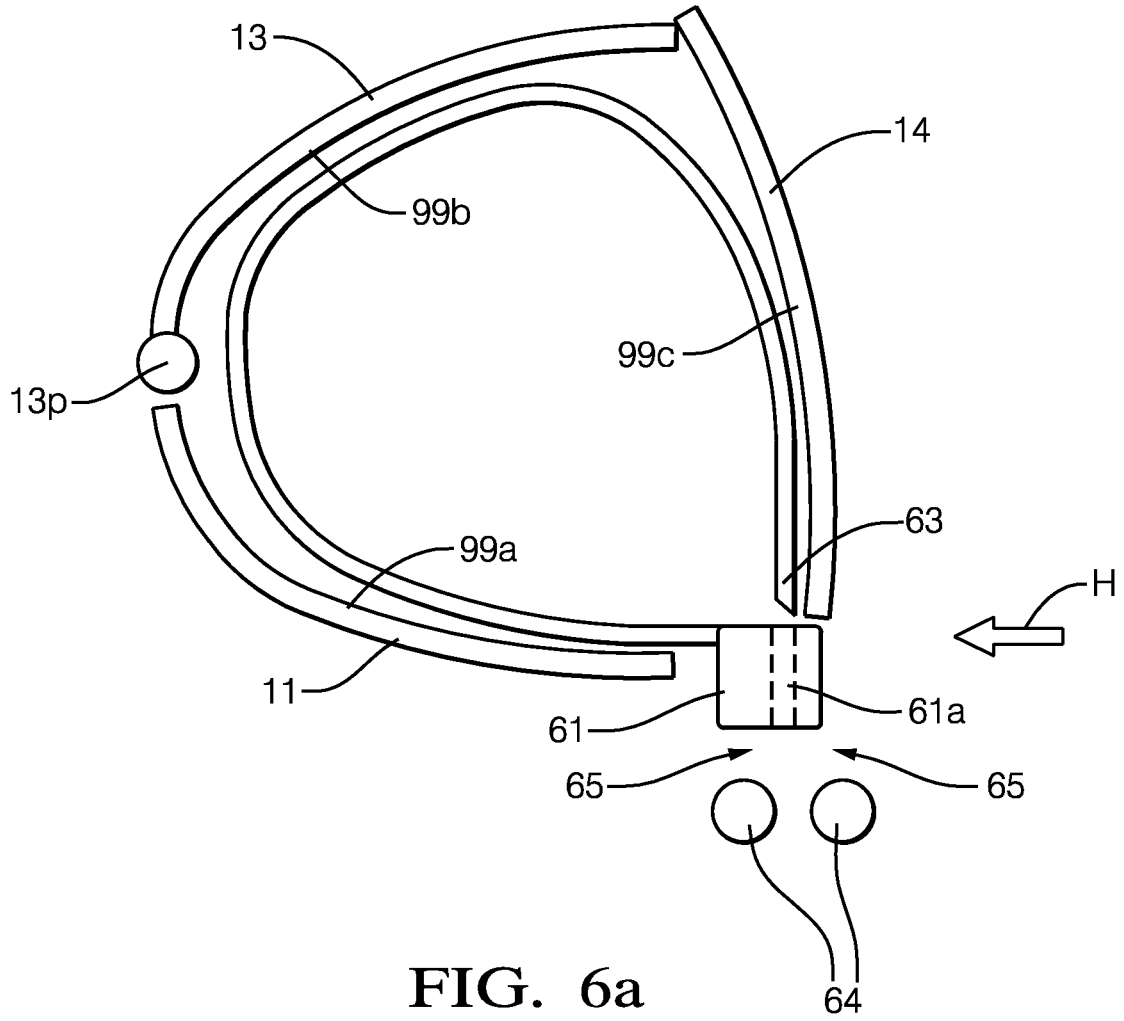
FIGS. 6*a* & 6*b* shows constructional details of the tool for mounting cable ties of FIG. 1 according to an embodiment of the invention.

A cable tie head with the opening therein indicated by the dashed channel 61*a*. The situation in FIG. 6 is a situation where the cable tie strap end 63 is placed opposite of and immediately adjacent to the cable tie head 61, particularly the opening 61*a* therein. This is achieved by the operation of a not shown insertion mechanism for the cable tie into the guidance path which may sit upstream of the upstream end of the upstream jaw. The insertion direction and insertion position of the cable tie towards the guidance path 99 is indicated by arrow H in FIG. 6*a*. 64 symbolizes a tightening device. It may consist of rollers catching the end once reaching through the opening 61*a* and may tighten it and pull it as far as pre-set criteria allow it. 65 symbolizes a cutting tool for cutting off the tail end at the downstream side of the cable tie head 61.

Support 15 symbolizes a support in the sense of a fixation point and may be seen as a part of the overall machine or machine body carrying the mentioned components. Particularly, the pivots 11*p* and 12*p* are attached to support 15. The support may consist of plural members fixedly or movably attached to each other.

The downstream jaw 12, 13, 14 may be formed by one or more holders 12, 12*l*, 12*r*. FIG. 1 shows a left side holder 12*l* and a right side holder 12*r* between which members are held that contribute to forming the guidance path. All the jaws 11, 12, 13, 14, guidance path portions 99*a*, 99*b*, 99*c* and holders 12*l*, 12*r* are of concave shape such that they encompass an opening in which the items to be tied 10 come to rest once the jaws are closed.

Figure 2:
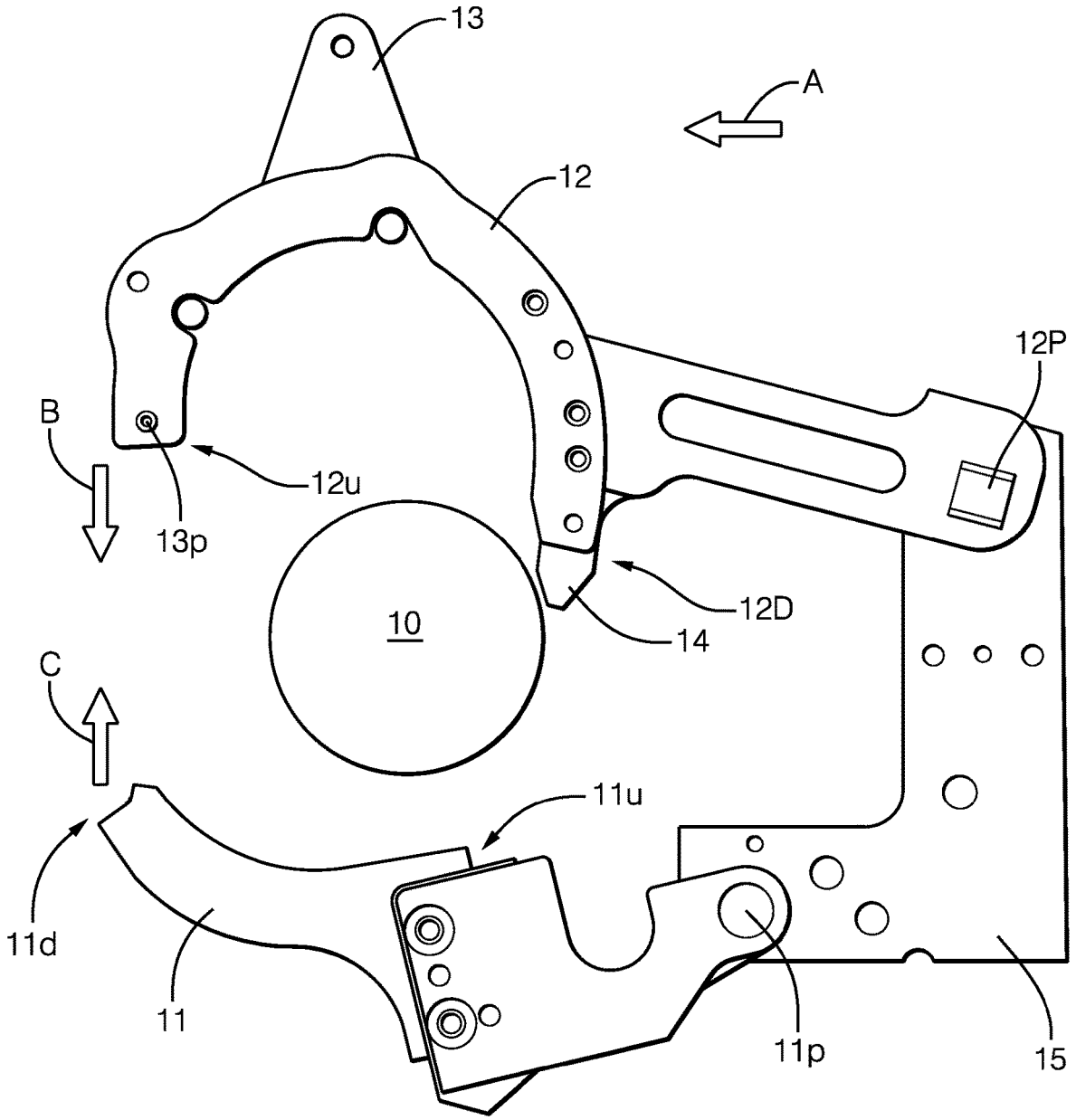
FIG. 2 shows a side view of the tool for mounting cable ties of FIG. 1 with jaws in an open position according to an embodiment of the invention.

FIG. 2 shows the situation of FIG. 1 in side view. In addition, arrows A, B and C indicate certain movements. When using the tool in a cable tie mounting method, the tool may be brought towards the item to be tied 10 along the direction indicate by arrow A. In this state, the jaws are open as shown, but will, once the correct position is taken, be closed along the directions of arrows B and C. Although the figures show constructions where both jaws are movable/pivotable, it may well be that only one of them is movable/pivotable. Instead of pivoting movements, also translational movements could be considered.

Figure 3:
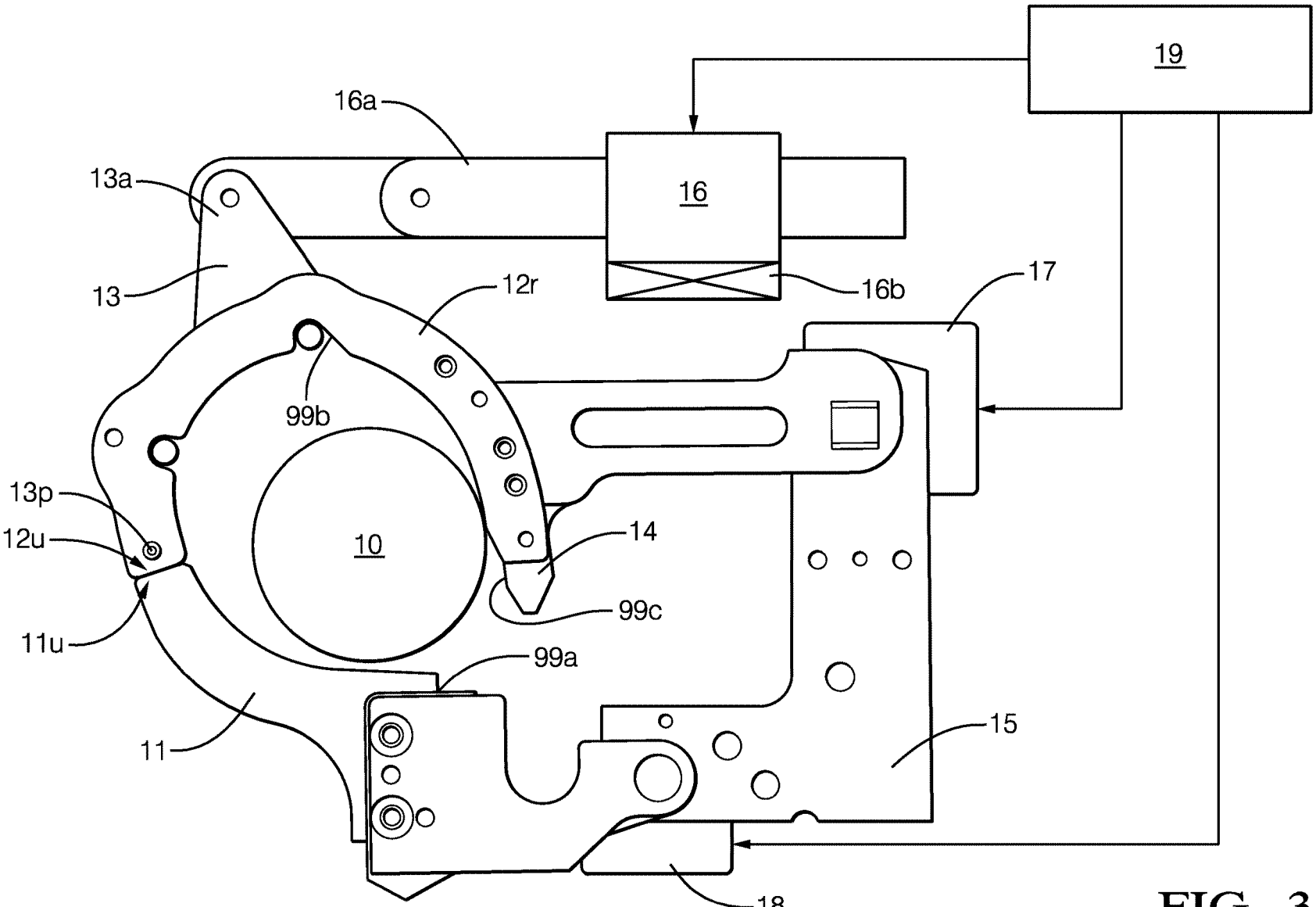
FIG. 3 shows a side view of the tool for mounting cable ties of FIG. 1 with jaws in a closed position together with further schematic features according to an embodiment of the invention.

FIG. 3 shows the jaws in a closed state. Then, the downstream end 11*d* of the upstream jaw 11 is close to, and possibly abuts at, the upstream end 12*u* of the downstream jaw 12, 13, 14.

FIG. 3 also shows schematically various drives. It shows drives 17 for the downstream jaw 12, 13, 14, and drive 18 for the upstream jaw 11. They may be distinct drives, possibly individually controllable, or may be attachments to a common gear or the like. FIG. 3 shows an embodiment where the drives 17, 18 of the jaws 11, 12, 13, 14 could individually be controlled by a controller 19. But as said, also other constructions are conceivable. FIG. 3 further shows a drive 16 for the pivotable path portion 13, 99*b*, pivoting, in the shown embodiment, around its pivot 13*p* at the upstream end 12*u* of the downstream jaw 12, 13, 14. Drive 16 may be a linear drive attached to a lever 13*a* extending radially outward away from the pivotable path portion 13. The linear drive may push the lever 13*a* in horizontal direction in FIG. 3 and thus may pivot the pivotable path portion 13, 99*b* around pivot 13*p*. 16*b* indicates the attachment of the drive 16 to the tool at a certain appropriate location. Attachment may be at the tool body as symbolized by support 15, but could also be rigid with respect to a portion of the downstream jaw 12-14, for example at holders 12*r* and/or 12*l*.

Figure 4A:
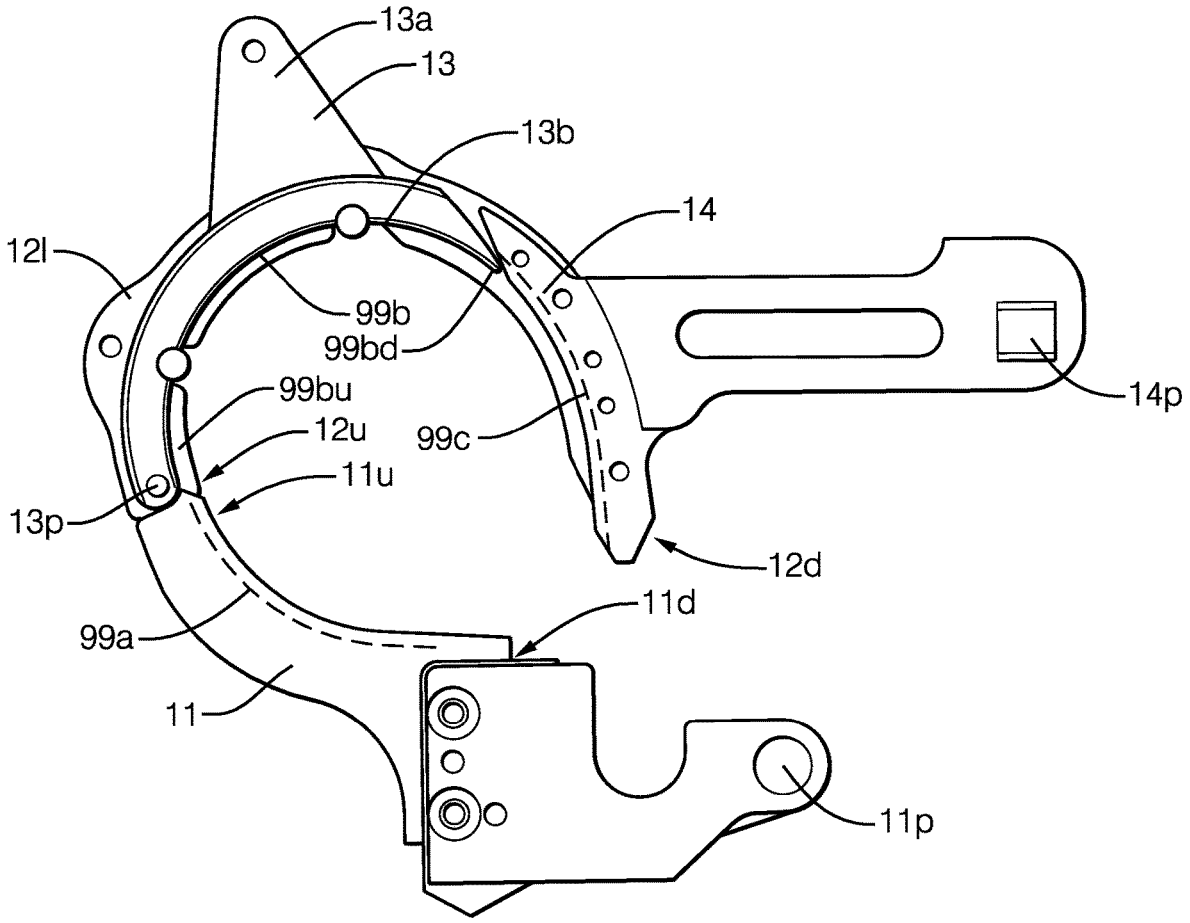
FIGS. 4*a* to 4*c* show various positions of a pivotable path portion of the tool for mounting cable ties of FIG. 1 according to an embodiment of the invention.
Figure 4B:
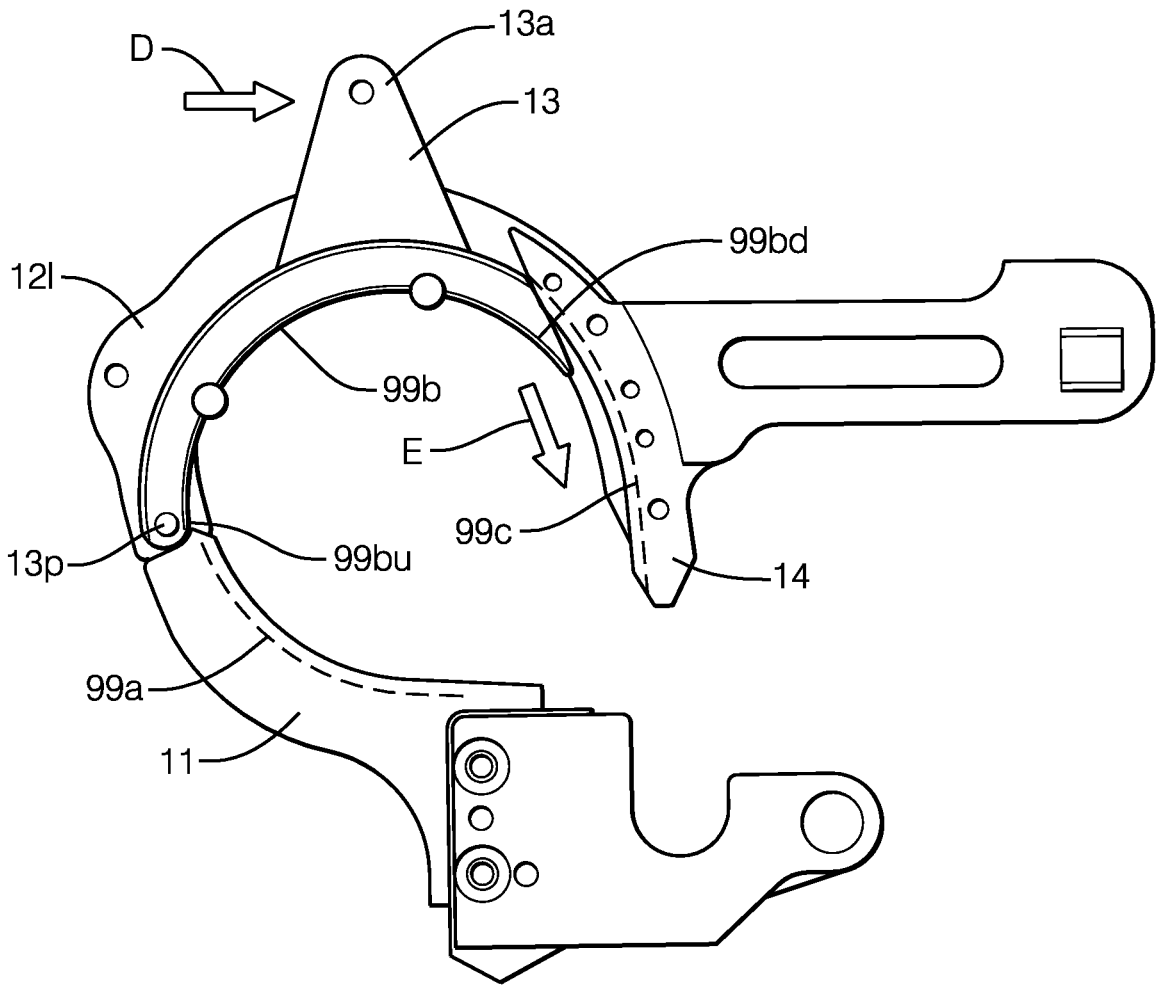
Figure 4C:
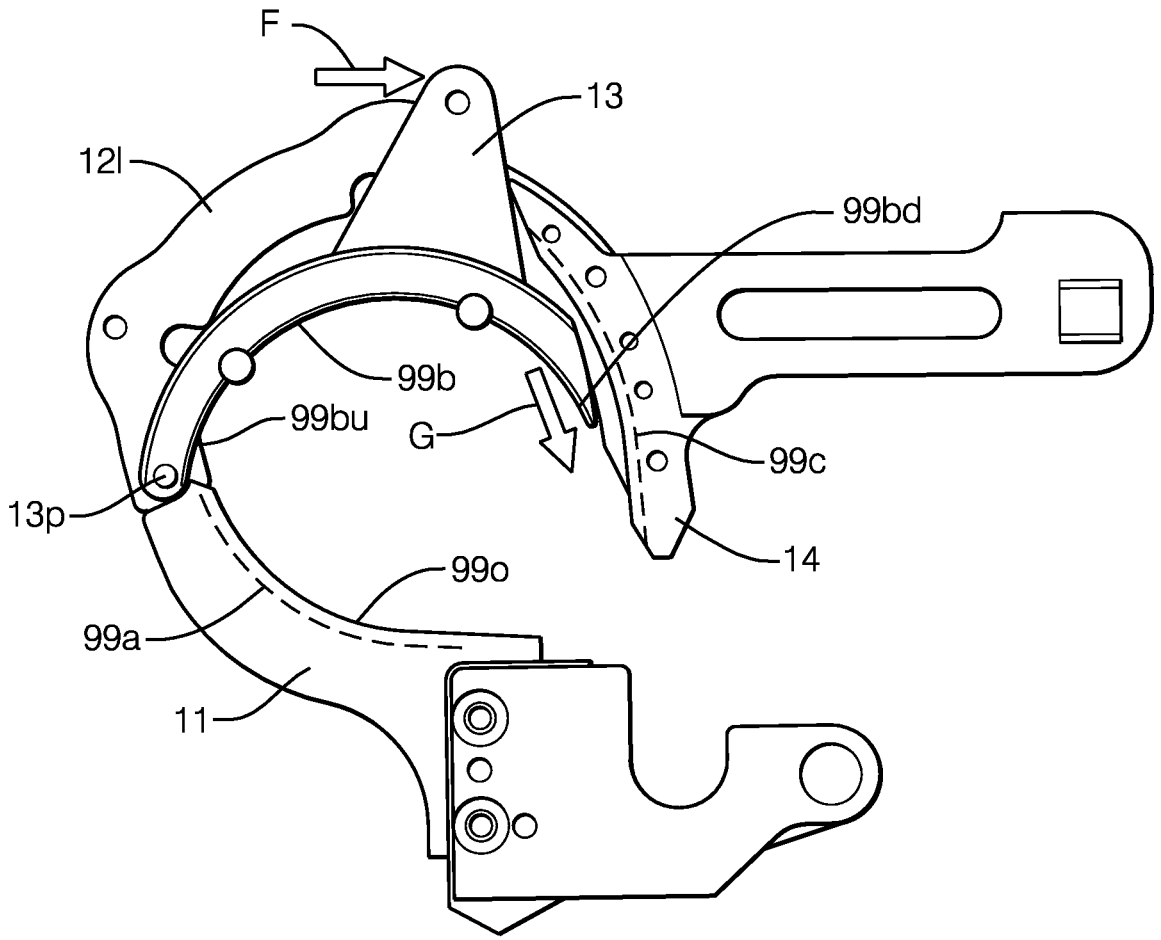

Various operational states of the pivoting path portion 13, 99*b* will now be described with reference to FIGS. 4*a*, 4*b* and 4*c*. Said figures do not show the various drives. But they are provided as explained with reference to FIG. 3. FIGS. 4*a*, 4*b*, 4*c* show only the jaws 11, 12, 13, 14, with the right side holder 12*r* of FIG. 1 left away for the sake of a clear visualization. For the same reason, the items to be tied 10 are not shown in FIGS. 4*a*, 4*b* and 4*c*, although they are present during regular use.

The pivotable path portion 13, 99*b* comprises a rail-like member 13*b* of concave shape bearing on its concave inner surface the actual guidance path portion 99*b* that is pivotable and has an upstream end 99*bu* and a downstream end 99*bd*. The pivot 13*p* is at the upstream end of the pivotable path portion 13, 99*b* and is also at the upstream end of the downstream jaw 12, 13, 14, as shown. At the distal ends (downstream end 11*d* of upstream jaw 11 and upstream end 12*u* of downstream jaw 12, 13, 14) the two path portions 99*a* of the upstream jaw 11 and 99*b* of the pivotable path portion 13, 99*b* are more or less contiguous, and a cable tie strap pushed along said path in downstream direction, i.e. from the upstream end flu of the upstream jaw 11 and then travelling in clockwise direction in FIG. 4*a*, will easily and reliably pass the transition between the path portions 99*a* and 99*b*.

As also shown in FIG. 4*a* the downstream end 99*bd* of the pivotable path portion 13, 99*b*, is close to the fixed guidance path portion 99*c*, and accordingly the cable tie strap also will easily pass from the pivotable path portion 99*b* towards the fixed path portion 99*c*.

In FIG. 4*a*, the upstream path portion 99*a* is shown by dashed lines. It can be understood as being hidden behind the sidewalls for sideways confining and guiding a strap travelling along the guidance path. Substantially the same applies with respect to the fixed guidance path portion 99*c*.

In FIG. 4*a*, the pivotable path portion 13, 99*b* is shown in the most retracted position, i.e. radially most outward position during regular use. This implies also that the lever 13*a* is, in FIG. 4*a*, in its left most position during regular use. In such a position, the inner holder contour of the holders 12*l*, 12*r* may be the confining contour of the opening defined by the closed jaws and surrounding the items to be tied 10. In this position, the length of the overall guidance path 99*a*, 99*b*, 99*c* is maximum because the guidance path runs along the maximum loop dimension in the downstream jaw 12, 13, 14.

It is pointed out in this context that all the FIGS. 1, 2, 3, 4*a*, 4*b* and 4*c* show that the downstream jaw 12, 13, 14 has the overall longer guidance path portion constituted by the two path portions 99*b*, 99*c* of the pivotable path portion 13, 99*b* and the fixed path portion 14, 99*c*. Together, they are longer than the guidance path portion 99*a* of the upstream jaw 11. The downstream path portions define, together a bent similar to a U-shape or horseshoe, bending a cable tie running around said path portion for around 180°, or more general between 140° and 220°. In contrast, the upstream jaw 11 has the shorter path portion 99*a*, which bends the cable tie strap for a lower angle which may below 110° or below 90° or below 80°.

But different from the shown embodiments, the downstream jaw may hold the shorter path portion and the upstream jaw may carry the longer path portion, and could then also carry the pivotable path portion, then again pivotably held at its upstream end.

FIG. 4*b* shows the pivotable path portion 13, 99*b* in a more inwardly pivoted position. Compared to FIG. 4*a*, the lever 13*a* was pushed by the not shown drive 16 in the direction of arrow D, i.e. rightward in FIG. 4*b*, this leading to a corresponding downward movement of the downstream end 99*bd* of the pivotable path portion along the direction of arrow E. Accordingly, the tangential extension of the downstream end of the pivotable path portion points to another position along the fixed path portion 99*c*. A gap between the two path portions widens. But the situation is still such that the leading end of the travelling cable tie strap 62 will reliably be caught by the fixed path portion 99*c* for further guidance there. Looking at the upstream end of the pivotable path portion, the transition between it and the upstream path portion 99*a* is more edgy than in FIG. 4*a*, but still such that it can be passed by the leading portion 63 of the cable tie strap 62.

Altogether, in FIG. 4*b* the guidance path length is decreased because the pivoted path portion "shortcuts" the maximum loop so that the overall length becomes shorter. Whereas the positioning shown in FIG. 4*a* could be suitable for the longest possible cable ties, the positioning of FIG. 4*b* could be suitable either for shorter cable ties before inserting their free end into the head of the cable tie, or could be suitable for inserting the end of the longest possible cable tie into its head. The movements indicated by FIG. 4*b* were induced by the not shown drive 16, possibly under control of controller 19.

FIG. 4*c* shows an again further pivoted position of the pivotable path portion 13, 99*b*. At the transition between upstream path portion 99*a* and pivotable path portion 13, 99*b*, an edge occurs. But constructions can be made such that a passing end 63 of a cable tie strap 62 reliably gets across the edge. At the downstream end 99*bd* of the pivotable path portion, the gap between it and the downstream fixed path portion 99*c* has increased. But still, the arrangement is such that the leading end 63 of a cable tie strap 62 will safely be caught by the fixed path portion 99*c*.

Movement of the pivotable path portion 13, 99*b* was such that the lever was again moved rightward as indicated by the direction of arrow F, and the downstream end 99*bd* thereof travelled downward along the of arrow G. Through this further pivoted position an even greater portion of the maximum available opening is shortcut, so that the guidance path length has again decrease compared to FIG. 4*b* and FIG. 4*a*. Assuming that the position shown in FIG. 4*c* is the most inward position of the pivotable path portion 13, 99*b* during regular use, it is a position assumed when the end of a cable tie strap has been pushed through the cable tie head for a short strap length. Again, the movements indicated by FIG. 4*c* were induced by the not shown drive 16, possibly under control of controller 19.

Figure 5:
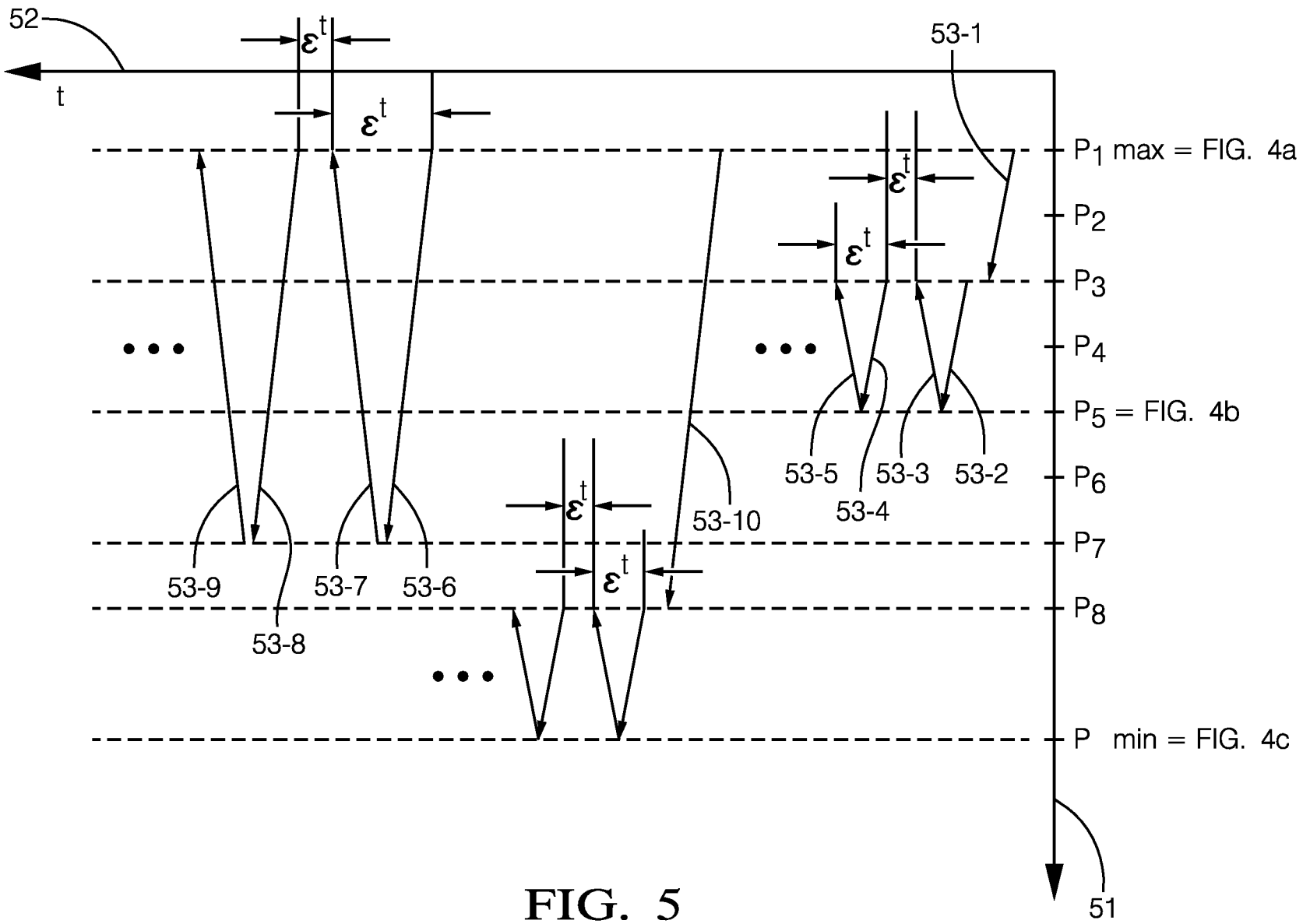
FIG. 5 shows an operation diagram for the tool for mounting cable ties of FIG. 1 according to an embodiment of the invention.

FIG. 5 is a diagram for showing operational methods of the described tool. The abscissa 51 shows qualitatively various pivoting positions P1, P2, . . . , P8, Pmin of the pivotable path portion 13, 99. P1 is most outward, Pmin most inward. The ordinate 52 shows elapsed time. It may be assumed that P1 correspond to the position shown in FIG. 4*a*, and, for example, P5 is the position shown in FIG. 4*b*, and Pmin is the position shown in FIG. 4*c*. More distinct positions than those shown in FIGS. 4*a*, 4*b* and 4*c* are possible and are indicated in FIG. 5 by the intermediate positions on the abscissa. The control may be such that these pivoting positions can be selected and then adjusted by drive 16.

In a first operational example, it is assumed that relatively long cable ties are to be mounted. A slightly reduced guidance path length corresponding to position P3 would be suitable for positioning the cable tie strap end right opposite of and adjacent to the opening in the cable tie head. It is further assumed, that position P5 would be the position sufficient for inserting the cable tie strap end into and through the cable tie head and into the reach of a tightening mechanism.

In operation, then, in a first step 53-1, the pivotable path portion is brought to position P3. Then, or before that, the tool can be brought to the mounting side and the jaws can be closed. Then, the cable tie is inserted into the guidance path. Once this is achieved, a movement 53-2 of the pivotable path portion towards position P5 follows for pushing the cable tie strap end 63 through the cable tie head 61 toward the reach of the tightening mechanism 64. Once this is done, the pivotable path portion retracts by movement 53-3. Then, the jaws are opened, the tool is displaced to a new mounting site, the jaws are closed and then the reversing operation between positions >>P5>>P3 is repeated by movements 53-4 and 53-5. The reversing movements 53-2 to 53-5 are relatively short since they must cover only the distance necessary for the cable tie end 63 to travel from the position immediately in front of the cable tie head opening 61*a* through said opening towards the reach of the tightening mechanism 64. This may be called work time tw of jaws, as indicated in FIG. 5. The dead time td is the time required for operating the jaws, namely opening and closing them, and displacing the tool as required.

Further down in FIG. 5 an example is assumed where the shortest possible cable tie is used, a position P8 being suitable for placing the tie. Then, a relatively long guidance path adjustment step 53-10 towards position P8 is required, and from there on the reversing movements between P8 and P9min ensues as described earlier. On the time line, after making the first adjustment towards position P8, the same timings as mentioned earlier are required.

So far, an operation method with distinct adjustment steps and inserting steps has been described. Variable is the first step for adjusting the guidance path length to the length of the mounted cable ties, whereas the various movements of the pivotable path portion 13, 99*b* thereafter, as indicated by 53-2 to 53-5, are the same because they must cover the same distance from upstream of the cable tie head opening 61*a* to downstream thereof into the reach of a tightening mechanism 64. Correspondingly, FIG. 6*a* shows the situation after a cable tie 61, 62, 63 has been placed along the guidance path 99 and before the required insertion activity is executed, this activity corresponding to movements 53-2 and 53-4 in FIG. 5. This would be a downward pivoting movement of the pivotable path portion 13, 99*b*, pivotably held at pivot 13*p*, and a reverse upward pivoting.

The lower portion of FIG. 5 shows another operation method. There, no distinct guidance path length setting is made. For example, when inserting the cable tie, the guidance path length may always be the same, i.e. maximum, irrespective of how long or short the used cable ties are. Then, after placing the cable tie along the guidance path portion, the reversing steps for pushing the cable tie strap end through the cable tie head opening 61*a* into the reach of a downstream tightening mechanism 64 may have different length depending on the length of the cable tie. Short cable ties will require a longer step, whereas longer cable ties will require a shorter step. In FIG. 5, it is assumed that position P7 is the position required for feeding the cable tie strap end through the cable tie head 61*a* into the reach of the tightening mechanism 64. Then, the reversing movements are longer. This increases the work time tw. The dead time td, however, remains the same. The longer reversing operations are shown with reference numerals 53-6, 53-7, 53-8 and 53-9. In the operation mode shown in the lower portion of FIG. 5, provisions must be taken for appropriately setting the target position P7. This may be made by a suitable control or may be accomplished by some kind of self-adjusting mechanism, such as force dependent, or may be feedback controlled, or the like.

Figure 6B:
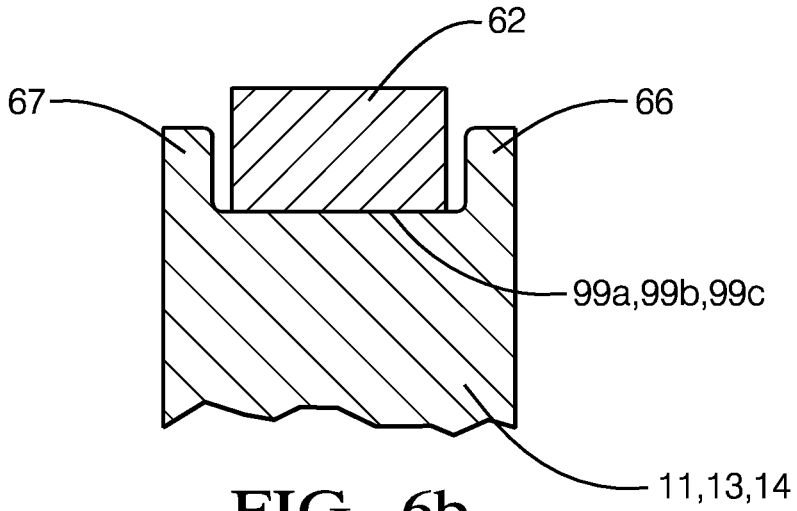

FIG. 6*b* is a cross section of the various guidance path portions 99*a*, 99*b*, 99*c* the downward direction in FIG. 6*b* is the radial outward direction of the loop formed by the guidance path. 62 is the cross section through the cable tie strap it abuts to the radial inside surface of the respective components, particularly upstream jaw 11, pivotable path portion 13, fixed path portion 14. Sidewalls 66, 67 maybe provided over parts or the entire length of the path portions for avoiding sideways escape, which would be, in FIG. 6*a*, vertical to the drawing plane. At the pivotable path portion, the sidewalls 66, 67 may be formed by the holders 12*l*, 12*r*, and would then be separate members.

Altogether, the described tool may be configured for handling cable ties of variable length, for example with a minimum length of 90 mm or 100 mm or 110 mm, and/or with a maximum length of 220 mm or 200 mm or 180 mm. The length of the inner circumference of the loop defined by the closed jaws and the pivotable path portion may thus be adjusted for handling said lengths. The length adjustment mechanism may be configured to reduce the guidance path length from its maximum to a length below 80% or below 70% or below 60% of the maximum length.

Features described in this specification shall be deemed combinable with each other also if their combination is not expressly mentioned, to the extent that this combination is technically feasible. Features described in a certain context, embodiment, figure or claim shall be deemed separable from this claim, context, figure or embodiment, to the extent that this is technically feasible, and shall be deemed combinable with other embodiments, contexts, figures or claims, to the extent that it is technically feasible. Descriptions of methods and method steps shall be deemed also as description of means for implementing the method or method step, and vice versa.

We claim:

1. A cable tie mounting tool, comprising:

an upstream jaw having a concave upstream guidance path portion for a strap of a cable tie with a first upstream end and a first downstream end seen along a guidance direction; and a downstream jaw having a concave downstream guidance path portion for the strap of the cable tie and a pivotable path portion attached to the downstream jaw, the pivotable path portion configured to rotate about a pivot on the downstream jaw, the downstream jaw having a second upstream end and a second downstream end, wherein the upstream jaw and the downstream jaw are movable relative to each other such that the first downstream end and the second upstream end may be close to each other or remote from each other, thereby forming a common concave guidance path for the strap of the cable tie when being close to each other;

wherein the pivotable path portion is configured to feed a strap end of the cable tie through a cable tie head of the cable tie and adjust a length of the common concave guidance path and wherein a length of the common concave guidance path is adjusted by moving the upstream jaw and the downstream jaw relative to each other and a first pivoting movement of the pivotable path portion around the pivot relative to the downstream jaw in a radially inward or radially outward direction.

2. The cable tie mounting tool according to claim 1, wherein a second pivoting movement of the pivotable path portion around the pivot in the radially inward or the radially outward direction is performed to feed the strap end of the cable tie through the cable tie head of the cable tie.

3. The cable tie mounting tool according to claim 2, wherein a pivot of the pivotable path portion is nearer to an upstream end of the pivotable path portion than to a downstream end.

4. The cable tie mounting tool according to claim 2, wherein the pivotable path portion is provided at the downstream jaw.

5. The cable tie mounting tool according to claim 1, further comprising a drive mechanism for the pivotable path portion, the drive mechanism having a linear drive configured for selectively driving the pivotable path portion two or more steps in series.

6. The cable tie mounting tool according to claim 1, further comprising a lever on the pivotable path portion, extending radially outward, and a linear drive attached to said lever, the linear drive configured for stepwise moving the pivotable path portion.

7. The cable tie mounting tool according to claim 1, wherein the upstream guidance path portion and the downstream guidance path portion have a different length.

8. The cable tie mounting tool according to claim 7, wherein the downstream jaw is longer than the upstream jaw.

9. The cable tie mounting tool according to claim 1, wherein the path portion and a drive mechanism of the pivotable path portion are arranged to guide the strap end of the cable tie towards varying positions along the fixed path portion depending on a pivot position of the pivotable path portion.

10. The cable tie mounting tool according to claim 1, wherein one or more of the path portions have a U-shaped contour, the U-shaped contour being open in a radial inward direction.

11. The cable tie mounting tool according to claim 10, configured for handling cable ties of variable length with a minimum length of 90 mm and a maximum length of 220 mm.

12. The cable tie mounting tool according to claim 10, wherein the pivotable path portion is configured to reduce the common concave guidance path length from its maximum length to 80% of the maximum length.

* * * * *